US005394054A

United States Patent [19]

Chen et al.

[11] Patent Number: 5,394,054

[45] Date of Patent: Feb. 28, 1995

[54] ELECTRON GUN WITH ELECTROSTATIC SHIELDING AND METHOD OF ASSEMBLY THEREFOR

[75] Inventors: Hsing-Yao Chen, Barrington, Ill.; Sen-Su Tsai, Taoyuan, Taiwan, Prov. of China

[73] Assignee: Chunghwa Picture Tubes, Ltd., Yangmei, Taiwan, Prov. of China

[21] Appl. No.: 92,961

[22] Filed: Jul. 19, 1993

[51] Int. Cl.[6] ..... H01J 29/51

[52] U.S. Cl. ..... 313/414; 313/412; 313/447; 313/460; 445/34

[58] Field of Search ..... 313/412, 414, 447, 449, 313/460; 315/15, 382; 445/34, 36

[56] References Cited

U.S. PATENT DOCUMENTS

| | | | |
|---|---|---|---|
| 2,217,168 | 10/1940 | Hefele et al. . | |
| 2,909,704 | 10/1959 | Peter . | |
| 2,957,106 | 10/1960 | Moodey . | |
| 3,154,710 | 10/1964 | Parker . | |
| 3,887,830 | 6/1975 | Spencer . | |
| 3,995,194 | 11/1976 | Blacker, Jr. et al. | 315/16 |
| 4,052,643 | 10/1977 | Yamazaki et al. | 313/414 |
| 4,253,041 | 2/1981 | Blacker et al. | 315/16 |
| 4,334,169 | 6/1982 | Takenaka et al. | 313/414 |
| 4,370,594 | 1/1983 | Kuzenetzoff | 313/458 |
| 4,427,917 | 1/1984 | Mizushima et al. | 313/414 |
| 4,468,587 | 8/1984 | Sluyterman | 313/413 |
| 4,528,476 | 7/1986 | Alig | 313/414 |
| 4,922,166 | 5/1990 | Ichida et al. | 313/414 |

*Primary Examiner*—Sandra L. O'Shea
*Assistant Examiner*—Vip Patel
*Attorney, Agent, or Firm*—Emrich & Dithmar

[57] ABSTRACT

An electron gun such as used in a cathode ray tube (CRT) includes an Einzel lens having charged G3, G4 and G5 grids for focusing an electron beam on the CRT's display screen. The G3, G4 and G5 grids are cylindrical and have the same inner diameter, with their respective longitudinal axes colinear and aligned with the electron beam axis. Where T is the thickness of a grid and L is the G3–G4 or G4–G5 spacing, or gap, shielding against stray electrostatic fields within the grids arising from stray electrons on either a grid-supporting glass bead or on the inner surface of the CRT's neck portion is provided by maintaining the relationship $3.0 \geqq T/L \geqq 0.75$. Another embodiment employs thinner grids having a thickness t with outward turned end flanges, or folded edges, disposed about facing edges of adjacent grids having a thickness T, where $T > t$ and the above-stated relationship of T/L is maintained. A common inner diameter of each grid facilitates alignment of the grids using a cylindrical mandrel disposed within and supporting the grids during electron gun assembly.

16 Claims, 2 Drawing Sheets

Fig. 3
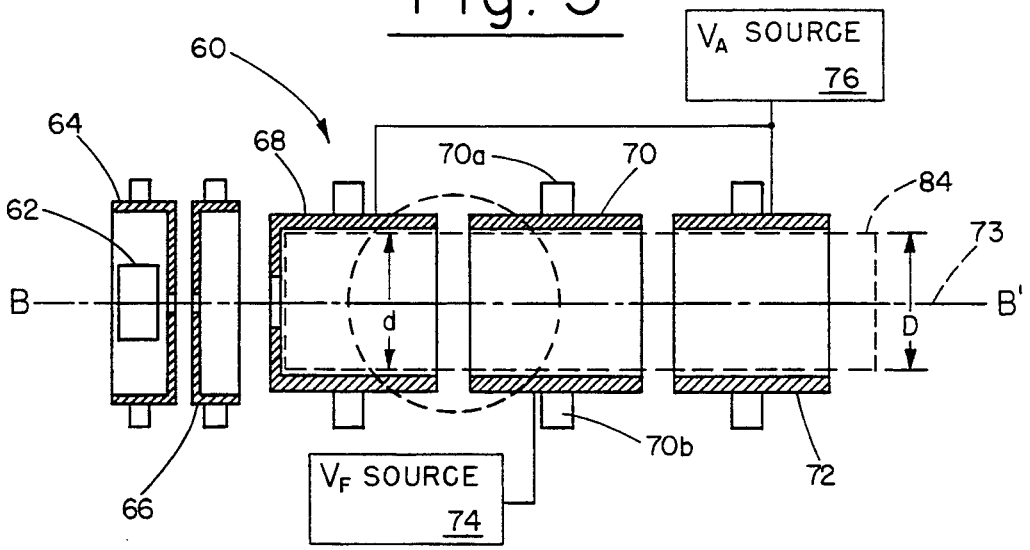
Fig. 4
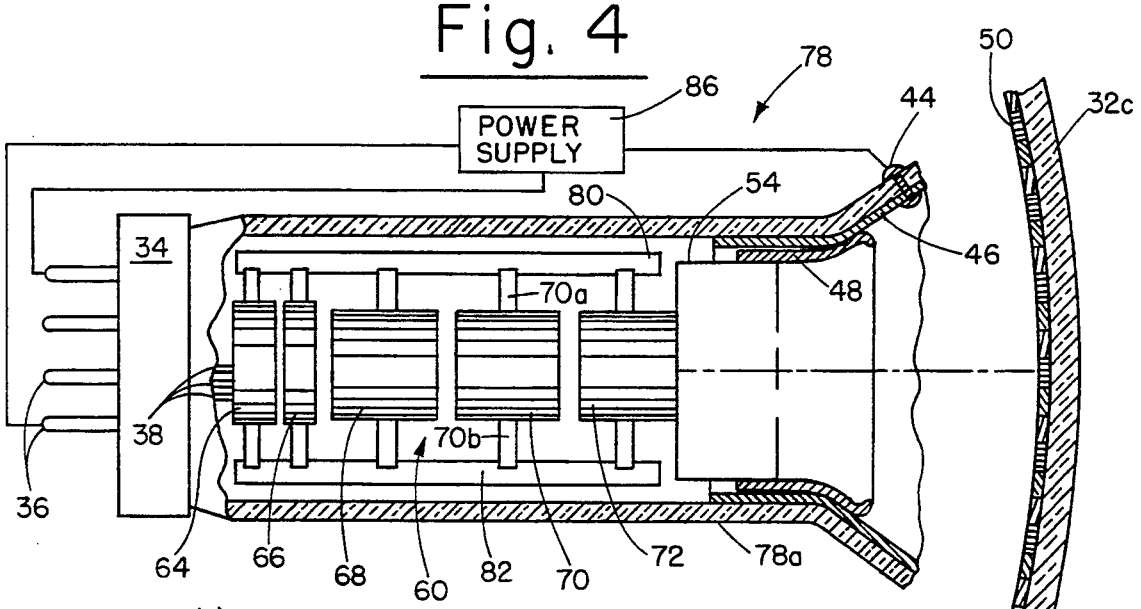
(a)
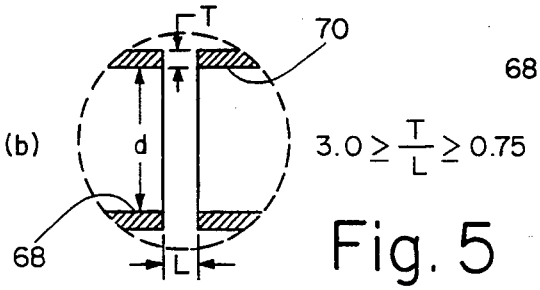
$3.0 \geq \frac{T}{L} \geq 0.75$
Fig. 5
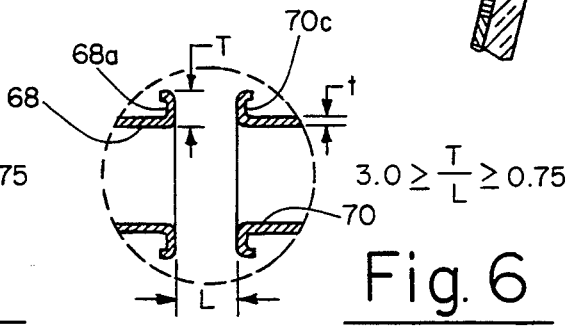
$3.0 \geq \frac{T}{L} \geq 0.75$
Fig. 6

ELECTRON GUN WITH ELECTROSTATIC SHIELDING AND METHOD OF ASSEMBLY THEREFOR

FIELD OF THE INVENTION

This invention relates generally to cathode ray tubes (CRTs) having an electron gun employing an electron beam focusing lens of the Einzel-type and is particularly directed to an improved Einzel lens for an electron gun and method of assembly therefor.

BACKGROUND OF THE INVENTION

In a conventional cathode ray tube (CRT), an electron gun comprised of a cathode and a plurality of aligned charged grids generates and forms energetic electrons into a beam and focuses the electron beam on the inner surface of a phosphor-coated faceplate. The electron gun is comprised generally of a beam forming region (BFR) and a beam focusing region. A focus voltage $V_F$ and an accelerating voltage $V_A$ are applied to various grids in the focusing portion of the electron gun, where $V_A > V_F$. The Einzel-type electron gun is a well known electron gun design which has been used for many years in CRTs. An advantage of the Einzel-type electron gun is that only one anode voltage $V_A$ source is required.

Referring to FIG. 1, there is shown a longitudinal sectional view of a prior art Einzel lens electron gun 10 for generating, accelerating and focusing an electron beam 12 on a CRT's faceplate (not shown for simplicity). Electron gun 10 includes a heated cathode 14 for generating energetic electrons and a plurality of charged grids aligned along axis A–A'. Electron gun 10 further includes a G1 control grid 16, a G2 screen grid 18, a G3 grid 20, a G4 grid 22, and a G5 grid 24. The combination of the G1 control grid 16, the G2 screen grid 18, and the facing portion of the G3 grid 20 comprise the BFR in electron gun 10. The G3 grid 20, the G4 grid 22 and the G5 grid 24 form the Einzel lens, or main lens, of the electron gun for focusing electron beam 12. The G3 grid 20 and the G5 grid 24 are coupled to an anode voltage ($V_A$) source 21, while the G4 grid is coupled to a focus voltage ($V_F$) source 19.

Because the G4 grid 22 is maintained at a much lower voltage than that of the G3 and G5 grids 20, 24 and because the velocity of the electrons in beam 12 is proportional to the square root of the accelerating voltage, or $$v = k \times V, \qquad \text{[Eq. 1]}$$

where v = velocity of electrons,

V = accelerating voltage, and k = proportional constant, the velocity of the electrons along axis A–A' in the vicinity of the G4 grid will be much less than that adjacent the G3 and G5 grids. In effect, the electrons slow down as they transit the G4 grid 22.

The electrons because of their lower velocity in this portion of the Einzel lens are more subject to stray electrostatic fields within the Einzel lens. Stray electrostatic fields arise from stray space charge effects due to electron deposit on an electrode support rod, or glass bead, (described below) as well as on the inner surface of the neck portion 32*a* of the CRT's glass envelope 32. The conventional low voltage Einzel lens design shown in FIG. 1 provides for overlapping of the G3 and G4 grids 20, 22 and the G4 and G5 grids 22, 24 to limit stray electrostatic fields introduced into the electron gun 10. While overlapping adjacent grids reduces the stray electrostatic field within the electron gun, the difference in diameters of the adjacent grids which permits this overlapping arrangement renders it more difficult to assemble the electron gun as described in the following paragraphs.

Referring to FIG. 2, there is shown a sectional view of a CRT 30 incorporating the electron gun 10 of FIG. 1, where the electron gun is shown in a side elevation view. CRT 30 includes a glass envelope 32 comprised of an elongated, narrow neck portion 32*a*, an expanding funnel portion 32*b*, and a glass faceplate 32*c* securely attached in a sealed manner to the CRT's funnel portion. An end of the CRT's neck portion 32*a* is fitted with a base member 34 typically comprised of plastic for attaching a plurality of conductive pins 36 to the end of the CRT envelope 32. Pins 36 extend through an end of the CRT's neck portion 32*a* and are electrically coupled to the various grids described above by means of a plurality of conductors 38. Pins 36 are further coupled to a power supply 52 for providing $V_A$, $V_F$ and other electrical signals to the various components within CRT 30. For simplicity, FIG. 2 shows the $V_F$, $V_A$ and other electrical signal sources as a single power supply 52. Power supply 52 is also coupled via an anode button 44 extending through the CRT's funnel portion 32*b* to a conductive coating 46 disposed on the inner surface of the CRT's glass envelope 32. The high anode voltage $V_A$ is provided to the CRT's screen via the anode button 44 and conductive coating 46. A conductive convergence cage 54 is disposed within the CRT 30 and is maintained in position therein by means of a snubber spring 48 which is disposed about the convergence cage and engages conductive coating 46. A video signal source (not shown for simplicity) provides video information to either the cathode or to the G1 control grid 16 for presenting a video image on the CRT's faceplate 32*c*. The inner surface of faceplate 32*c* is provided with a layer of phosphor elements 50, each of which illuminates when the electron beam 12 is incident thereon.

Convergence cage 54 is maintained at the anode voltage $V_A$ and is typically coupled to the high end of the G5 grid 24. The G1 control, G2 screen, G3, G4 and G5 grids 16, 18, 20, 22 and 24 are each provided with two or more metallic tabs, or studs, for attaching each of the grids to two or more insulating electrode support rods which are shown as elements 40 and 42 in FIG. 2. As shown for the case of the G2 screen grid 18, first and second metallic tabs 28*a* and 28*b* extend from the grid and are respectively attached to the first and second electrode support rods 40 and 42. The first and second electrode support rods 40, 42 as well as the convergence cage 54 provide support for electron gun 10 within the neck portion 32*a* of the CRT's glass envelope 32.

In assembling electron gun 10, a grid positioning-/alignment mechanism, shown in FIG. 1 in simplified schematic and dotted-line form as element 26, is used to align the G3, G4 and G5 grids 20, 22 and 24 forming the Einzel lens. The grid positioning/alignment mechanism 26 engages respective outer portions of the G3, G4 and G5 grids 20, 22 and 24 for mutually aligning these three grids as well as for aligning these grids with the G1 control and G2 screen grids 16, 18 during attachment to the first and second electrode support rods 40, 42. To maintain a small electron beam spot size and to ensure proper focusing of electron beam 12 on faceplate 32c, it is essential that the various charged grids be concentrically aligned with respect to axis A–A'. Employment of the grid positioning/alignment mechanism 26 shown in FIG. 1 for aligning the grids makes it impossible to use mandrel beading which is a common technique used in CRT assembly to control the concentricity of the stack of electrodes along the electron beam path. The concentric alignment of the overlapping G3, G4 and G5 Einzel lens grids 20, 22 and 24 when employing a conventional grid positioning/alignment mechanism 26 is controlled by the outer circumference of these grids. The accuracy of the concentric positioning of these grids along axis A–A' is limited by the mechanical tolerance of the various individual components. These mechanical tolerances, such as grid thickness and out-of-roundness, render it virtually impossible to precisely align the grids along a common axis.

The present invention addresses the aforementioned limitations of the prior art by providing an electron gun having an Einzel lens which permits the use of mandrel beading for electron gun alignment and assembly while providing a high degree of shielding against stray electrostatic fields within the electron gun.

OBJECTS AND SUMMARY OF THE INVENTION

Accordingly, it is an object of the present invention to provide an improved electron gun having an Einzel lens, and method of assembly therefor.

It is another object of the present invention to provide an Einzel lens for an electron gun wherein the electrostatic field effect on the gun's electron beam from stray electrons is avoided by maintaining a specified relationship between inter-grid spacing and grid thickness.

Yet another object of the present invention is to facilitate precise alignment of the cylindrical grids in an Einzel lens electron gun by employing grids having the same diameter.

A further object of the present invention is to facilitate assembly of an electron gun incorporating an Einzel lens using a cylindrical mandrel for supporting the grids of the lens in alignment during assembly.

A still further object of the present invention is to provide a pair of adjacent grids in an Einzel lens having facing folded edges of thickness T, where T is specified in terms of the gap between the grids, for avoiding the effects of stray electrostatic fields on an electron beam focused by the lens.

Still another object of the present invention is to provide an improved method for assembling an electron gun with an Einzel lens which ensures precise alignment of the G3, G4 and G5 grids of the lens.

These objects of the present invention are achieved and the disadvantages of the prior art are eliminated by a main focus lens for use in a cathode ray tube (CRT) wherein a beam of energetic electrons is directed onto phosphor elements disposed on an inner surface of a faceplate for forming a video image on the faceplate, the main focus lens comprising: first and second cylindrical grids disposed in a spaced manner along the electron beam and having respective longitudinal axes coincident with an axis of the electron beam, wherein the first and second grids are charged to an accelerating voltage $V_A$ and wherein the first and second grids each include facing end portions respectively having a thickness T; and a third cylindrical grid disposed intermediate the first and second grids and having a longitudinal axis coincident with the axis of the electron beam, wherein the third grid is charged to a focusing voltage $V_F$, where $V_A > V_F$, and wherein the third grid includes first and second end portions respectively disposed adjacent to the facing end portions of the first and second grids and having the thickness T, and wherein the first and second end portions of the third grid are disposed a distance L along the electron beam axis from the facing end portions of the first and second grids, respectively, wherein the first, second and third grids have a diameter D and $3.0 \geqq T/L \geqq 0.75$.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 3 is a longitudinal sectional view of an Einzel lens electron gun in accordance with the principles of the present invention;

FIG. 4 is a fragmentary longitudinal sectional view of a CRT incorporating the Einzel lens electron gun of FIG. 3, where the electron gun is shown in side elevation view;

FIG. 5 is an enlarged portion of the electron gun of FIG. 3 illustrating dimensional details of the thickness of the G3 and G4 grids as well as the spacing between these two adjacent grids; and FIG. 6 is an enlarged portion of a sectional view similar to that of FIG. 5 illustrating another embodiment of an Einzel lens electron gun in accordance with the present invention.

DETAILED DESCRIPTION OF THE PREFERRED EMBODIMENTS

Figure 1:
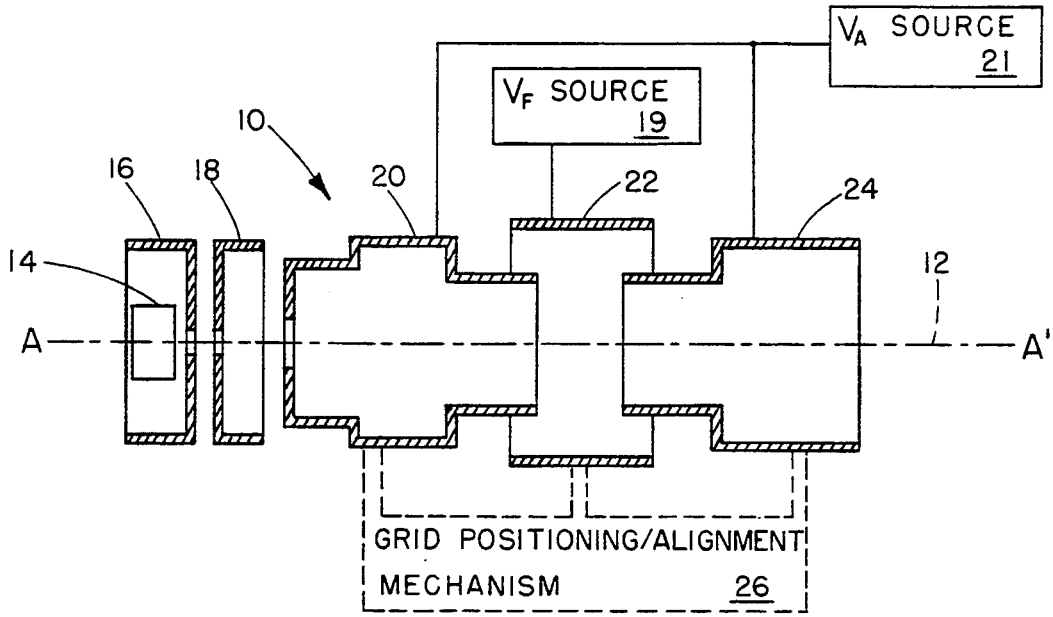
Fig. 1 (PRIOR ART)
FIG. 1 is a longitudinal sectional view of a prior art Einzel lens electron gun.

Referring to FIG. 3, there is shown a sectional view of an Einzel lens electron gun 60 in accordance with the present invention. Electron gun 60 includes a heated cathode 62 for emitting energetic electrons. Electron gun 60 further includes a G1 control grid 64 and a G2 screen grid 66 having aligned apertures for passing the energetic electrons in the form of a beam shown as element 73 (in dotted-line form) toward the faceplate of a CRT (not shown). Electron gun 60 further includes a G3 grid 68, a G4 grid 70, and a G5 grid 72 which in combination form an Einzel lens for focusing the electron beam 73 on the CRT's faceplate. The G1 control grid 64, G2 screen grid 66, and the facing portion of the G3 grid 68 comprise a beam forming region (BFR) for forming the energetic electrons emitted by cathode 62 into electron beam 73. The G3 grid 68 and G5 grid 72 are coupled to and charged by an anode voltage ($V_A$) source 76. The G4 grid 70 is coupled to and charged by a focus voltage ($V_F$) source 74.

Figure 2:
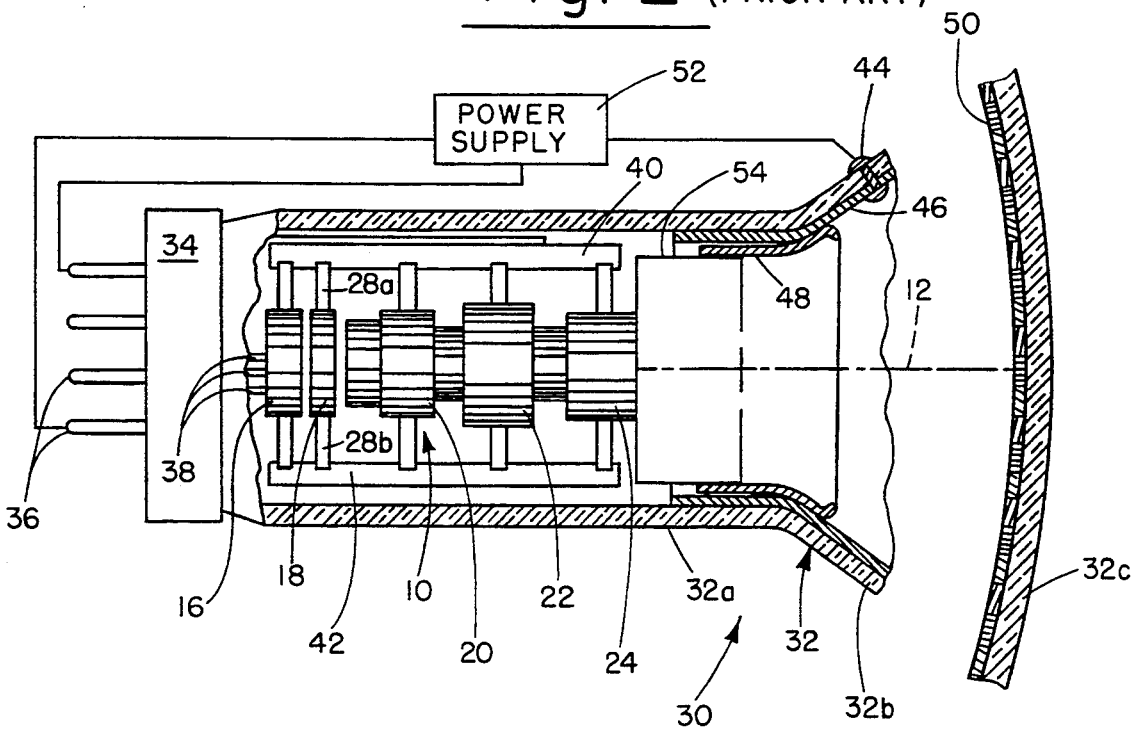
Fig. 2 (PRIOR ART)
FIG. 2 is a fragmentary longitudinal sectional view of a CRT incorporating a prior art Einzel lens electron gun, where the electron gun is shown in side elevation view.

Referring also to FIG. 4, which is a side elevation view of electron gun 60 as positioned within a CRT 78 shown in section, additional details of the invention will now be described. Those elements common to the prior art CRT 30 shown in FIG. 2 and described above are identified by the same element number in FIG. 4. For the sake of brevity, those elements in CRT 78 which perform the same function in the same manner as previously described with respect to FIG. 2 are not further discussed herein. Also for the sake of simplicity, the $V_F$ and $V_A$ sources 74 and 76 are shown as a single power supply 86 in FIG. 4.

As shown in FIG. 3, the G3, G4 and G5 grids 68, 70 and 72 are shown as having the same inner diameter d. These three grids are thus adapted to receive a generally cylindrical mandrel 84 shown in dotted-line form in FIG. 3 during assembly of electron gun 60. Mandrel 84 has an outer diameter D which is approximately equal to, but slightly less than the inner diameter d of the three grids of the Einzel lens. By appropriate selection of the outer diameter D of mandrel 84, the mandrel may be inserted within the G3, G4 and G5 grids 68, 70 and 72 in a tight-fitting manner to provide support for the grids during assembly of the electron gun 60. Mandrel 84 maintains the three grids of the Einzel lens in fixed alignment as the grids of electron gun 60 are attached to first and second electrode support rods 80 and 82 by means of a conventional glass beading process. Each of the grids of electron gun 60 includes two or more tabs extending from the periphery thereof for attaching the grids to the first and second electrode support rods 80, 82. This is particularly shown in the case of the G4 grid 70 which is shown as including first and second metallic tabs 70*a* and 70*b* extending from the periphery thereof which are adapted for attachment to the first and second electrode support rods 80, 82, respectively.

Referring to FIG. 5, there is shown an enlarged portion of the electron gun 60 of FIG. 3 illustrating details of the spacing and thicknesses of the G3 and G4 grids 68, 70. As shown in the figure, the G3 and G4 grids 68, 70 each have a thickness T and an inner diameter d, as previously described. In addition, the spacing between adjacent edge portions of the G3 and G4 grids 68, 70 is shown as L. In accordance with one aspect of the present invention, the relationship between grid thickness T and the inter-grid spacing L is given by the following:

$$3.0 \geqq T/L \geqq 0.75.$$

By maintaining the ratio of T/L less than or equal to 3.0 and greater than or equal to 0.75, grid thickness and inter-grid spacing prevents stray electrostatic fields outside of the electron gun from entering the space within the charged grids. If grid thickness T is less than or the inter-grid spacing L is greater than that which is necessary to maintain the above cited relationship between T and L, the electron beam passing through the grids of electron gun 60 will be subject to the influence of external stray electrostatic fields such as arising from stray electrons on the electrode support rods 80, 82 on the inner surface of the CRT's neck portion 78*a*. The influence of stray electrostatic fields on the electron beam inhibits beam focusing and degrades electron beam spot size.

Referring to FIG. 6, there is shown an enlarged portion of another embodiment of an Einzel lens electron gun in accordance with the present invention. In the embodiment shown in FIG. 6, the G3 and G4 grids 68, 70 have a reduced thickness of t. In addition, each of the G3 and G4 grids 68, 70 is provided with a respective outwardly folded edge 68*a* and 70*c*. The outwardly folded edges 68*a*, 70*c* have a thickness T, where T>t. The inter-grid spacing between the adjacent edges of the G3 and G4 grids 68, 70 is L. In accordance with this aspect of the invention, stray electrostatic fields are prevented from entering the space within and between the grids of electron gun 70 if the following relationship between T and L is maintained:

$$3.0 \geqq T/L \geqq 0.75.$$

There has thus been shown an improved Einzel lens electron gun which permits mandrel beading of the electron gun's grids during assembly of the electron gun while maintaining precise grid alignment, while avoiding the effects of stray electrostatic fields upon the gun's electron beam. By providing the G3, G4 and G5 grids of the electron gun's Einzel lens with the same inner diameter, a cylindrical mandrel may be inserted within and through these grids for maintaining the grids in precise alignment during assembly of the electron gun. The gap, or spacing, L between adjacent grids is defined in terms of the thickness of the adjacent grids by the following expression: $3.0 \geqq T/L \geqq 0.75$. Maintaining this relationship prevents external electrostatic fields arising from stray electrons on either the inner surface of the CRT's neck portion or on electron gun support structure from entering the electron gun and degrading focusing of the electron beam on the CRT's faceplate. The required thickness T may be achieved by providing adjacent grids with this thickness throughout their entire length, or by providing a thinner grid with an outwardly folded edge portion of thickness T.

While particular embodiments of the present invention have been shown and described, it will be obvious to those skilled in the art that changes and modifications may be made without departing from the invention in its broader aspects. Thus, while this invention has been described primarily in terms of use in a single beam electron gun such as employed in a monochrome CRT, this invention is equally applicable to electron guns having a plurality of electron beams such as used in color CRTs. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. For use in a cathode ray tube (CRT) wherein a beam of energetic electrons is directed onto phosphor elements disposed on an inner surface of a faceplate for forming a video image on said faceplate, a main lens for focusing said electron beam on said faceplate, said main lens comprising:

first and second cylindrical hollow grids disposed in a spaced manner along the electron beam and having respective longitudinal axes coincident with an axis of the electron beam, wherein said first and second grids are charged to an accelerating voltage $V_A$ and wherein said first and second grids each include facing end portions respectively having a same thickness T; and a third cylindrical hollow grid disposed intermediate said first and a second grids and having a longitudinal axis coincident with the axis of the electron beam, wherein said third grid is charged to a focusing voltage $V_F$, where $V_A > V_F$, and wherein said third grid includes first and second end portions respectively disposed adjacent to said facing end portions of said first and second grids and having said thickness T, and wherein said first and second end portions of said third grid are disposed a distance L along said electron beam axis from the facing end portions of said first and second grids, respectively, wherein said first, second and third grids have a same diameter D wherein $3.0 \geqq T/L \geqq 0.75$.

2. The main lens of claim 1 wherein said first and second grids are respectively G3 and G5 grids and said third grid is a G4 grid.

3. The main lens of claim 1 wherein each of said first, second and third grids has said thickness T over their respective entire lengths.

4. The main lens of claim 1 wherein the end portions of said first, second and third grids each includes a folded edge portion having said thickness T.

5. The main lens of claim 4 wherein said folded edge portion comprises an outwardly folded edge portion.

6. The main lens of claim 5 wherein each of said first, second and third grids further includes an inner cylindrical portion disposed inwardly from a folded edge portion thereof and having a thickness t, where $t < T$.

7. For use in an Einzel lens for focusing a beam of energetic electrons on a faceplate of a cathode ray tube (CRT), an arrangement for shielding said electron beam from stray electrostatic fields outside of said lens, said arrangement comprising:

a first cylindrical hollow charged grid having an edge with a thickness T and a longitudinal axis coincident with an axis of the electron beam, wherein said first grid is charged to an anode voltage $V_A$; and a second cylindrical hollow charged grid having said thickness T and a longitudinal axis coincident with said axis of the electron beam, wherein said second grid is charged to a focus voltage $V_F$, where $V_A > V_F$, and wherein said first and second grids are equal in diameter and separated by a distance L, where $3.0 \geqq T/L \geqq 0.75$.

8. The arrangement of claim 7 wherein said first grid is a G4 grid and said second grid is a G3 or G5 grid.

9. The arrangement of claim 7 wherein said first and second grids include facing edge portions having said thickness T and inner portions having a thickness t, where $T > t$.

10. The arrangement of claim 9 wherein said facing edge portions of said first and second grids each include an outwardly folded flange having said thickness T.

11. For use in an Einzel lens having a plurality of spaced, charged grids for directing an electron beam along an axis and for focusing said electron beam on a faceplate of a cathode ray tube (CRT), an arrangement for facilitating alignment of said charged grids during assembly of said Einzel lens, said arrangement comprising:

first and second cylindrical hollow grids disposed in a spaced manner along and having respective longitudinal axes coincident with said axis along which the electron beam is directed, wherein each of said first and second grids has a same inner diameter d and is charged to an anode voltage $V_A$;

a third cylindrical hollow grid disposed in a spaced manner intermediate said first and second grids and charged to a focus voltage $V_F$, where $V_F < F_A$, and wherein said third grid also has said inner diameter d; and cylindrical mandrel means having an outer diameter D, where $D < d$, and wherein said mandrel means is adapted for tight-fitting positioning within said first, second and third grids for supporting said grids in mutual alignment along said axis during assembly of said Einzel lens.

12. The arrangement of claim 11 further comprising support means for engaging an outer periphery of each of said grids and for maintaining said grids in alignment in the CRT.

13. The arrangement of claim 12 wherein said support means includes a plurality of spaced, generally parallel glass insulating rods.

14. The arrangement of claim 13 wherein each of said grids includes a plurality of tabs disposed in a spaced manner about a respective periphery thereof for engaging a respective glass insulating rod for maintaining said grids in alignment.

15. A method for assembling an electron gun having an Einzel lens, said method comprising the steps of:

providing a plurality of hollow, cylindrically shaped grids including first, second and third grids each having an inner diameter d;

aligning said plurality of grids along a common axis, including inserting a cylidrical mandrel having an outer diameter D within said first, second and third grids for supporting and maintaining said first, second and third grids in common alignment on said axis, where $D < d$; and attaching said plurality of grids to a plurality of rigid, insulating support members in assembling said electron gun.

16. The method of claim 15 wherein the step of attaching said plurality of grids to said support members includes mandrel beading said grids to a plurality of insulating glass support rods.

* * * * *

UNITED STATES PATENT AND TRADEMARK OFFICE

CERTIFICATE OF CORRECTION

PATENT NO. : 5,394,054

DATED : February 28, 1995

INVENTOR(S) : Hsing-Yao Chen and Sen-Su Tsai

It is certified that error appears in the above-indentified patent and that said Letters Patent is hereby corrected as shown below:

On title page, item [75] change "Prov. of China" to --Republic of China--.

On title page, item [73], change "Prov. of China" to --Republic of China--.

Signed and Sealed this

Twenty-ninth Day of August, 1995

*Attest:*

*Attesting Officer*

BRUCE LEHMAN

*Commissioner of Patents and Trademarks*